United States Patent [19]

Chou et al.

[11] 4,390,607

[45] Jun. 28, 1983

[54] CHARGE TRANSFER IMAGING PROCESS

[75] Inventors: Hsin-hsin Chou, Woodbury; William A. Hendrickson, St. Paul, both of Minn.

[73] Assignee: Minnesota Mining and Manufacturing Company, St. Paul, Minn.

[21] Appl. No.: 345,401

[22] Filed: Feb. 3, 1982

[51] Int. Cl.[3] ..... G03G 13/18

[52] U.S. Cl. ..... 430/48; 430/56; 430/134; 430/126

[58] Field of Search ..... 430/48, 56, 134

[56] References Cited

U.S. PATENT DOCUMENTS

| | | | |
|---|---|---|---|
| 3,245,577 | 4/1966 | Virzi | 220/64 |
| 3,772,010 | 11/1973 | Weiss | 96/1 R |
| 3,816,840 | 6/1974 | Kotz | 346/74 ES |
| 3,852,151 | 12/1974 | Knapp | 161/162 |
| 3,972,714 | 8/1976 | Weber et al. | 96/1 TE |
| 4,094,750 | 6/1978 | Mackey | 204/56 R |
| 4,263,359 | 4/1981 | Kitts, Jr. | 428/195 |
| 4,295,714 | 10/1981 | Payne | 354/3 |

FOREIGN PATENT DOCUMENTS 1417628 10/1925 United Kingdom .

OTHER PUBLICATIONS

Electron Microscopy Society of America, 33rd Annual Meeting Published Proceedings 1975 "Formation Mechanism for Multiply Twinned Particles During Nucleation in the Au/MICA System" Earl H. Lee and Helmut Poppa.

J. S. Sovey, "Ion Beam Sputtering of Fluoropolymers," J. Vac. Sci. Technol., 16(2), Mar./Apr. 1979, pp. 813–815.

J. M. Burkstrand, "Metal-Polymer Interfaces: Adhesion and X-Ray Photoemission Studies," J. Appl. Phys, 52(7) Jul. 1981, pp. 4795–4800.

R. M. Schaffert, Electrophotography, 1975, Focal Press, pp, 166–177.

*Primary Examiner*—John D. Welsh

[57] ABSTRACT

Imaging processes where charge images are transferred from one surface to another are improved by the presence of conductivity sites on at least one of the surfaces, said sites being discrete, composed of an inorganic material, and having an average length between 1.0 and 20 nm. Between 0.1 and 40% of either the photoconductive surface or dielectric layer may be covered with electrically conductive sites.

11 Claims, No Drawings

CHARGE TRANSFER IMAGING PROCESS

TECHNICAL FIELD

This invention relates to photoconductive imaging processes and in particular to charge transfer photoconductive imaging processes.

BACKGROUND ART

Transfer of electrostatic images (TESI) from a photoconductor acting as the primary image receiver to a dielectric surface is well known in the art (cf. *Electrophotography,* R. M. Schaffert, pp. 167–177, Focal Press, 1975). In a typical charge transfer process, a photoconductive layer bearing a conventionally made charge image is positioned near a dielectric receiving layer and a voltage of suitable polarity is applied between conductive substrates on the sides of these layers facing away from each other. The positioning of the layers must be such that a dielectric breakdown of the air between the layers can occur when a reasonable maximum voltage (e.g., typically less than 2000 volts) is applied. The dielectric receiving layer is then removed from the photoconductor while maintaining a biasing voltage. At a critical point in the separation, discharge currents flow across the air gap so as to transfer at least some of the original image charge on the photoconductor in an imagewise fashion to the dielectric receiving layer. This transferred electrostatic image may be made visible by conventional toning techniques. Variations on this technique have been developed and are described in the art. However, the importance of the thickness and uniformity of the gap between the donor and receptor is a factor in them all.

To obtain good quality images it is desirable during the transfer step to maintain a precise air gap between the photoconductive and receiving layers. Air gap separations of the order of a few microns have generally been thought to be desirable. If the gap is too large, little or no charge will transfer; while if it is too small, there can be considerable transfer of charge in the background areas resulting in a mottled background. In addition, because the relationship between the voltage needed to cause dielectric breakdown in the air gap and the air gap spacing (the Paschen curve) is not constant, a uniform air gap spacing is desirable for high quality transfer images.

Processes known in the prior art for the transfer of electrostatic images (TESI) have found practical application in commercial electrophotographic or electrostatic printing only for low resolution images.

In electrophotography or electrostatic printing, the prior art techniques for accomplishing charge transfer from one surface to another involves either: (1) conduction of electric charges across an air gap, or (2) direct charge transfer if the air gap is eliminated. While the air breakdown charge transfer technique is simple, it does not provide high resolution (less than 80 line pairs per millimeter (lp/mm) can be achieved) or continuous tone gray scale reproduction. Finally, this method also requires the donor surface to sustain high surface potentials to insure air breakdown. The presently known techniques for direct charge transfer require very smooth surface, a transfer liquid interfacing the donor and receptor films, or very high pressures to eliminate the air gap. Even though high resolution of up to 150 lp/mm charge transfer has been claimed, these techniques are impractical and the charge transfer efficiency is generally low. Accordingly, there remains a need for a simple means of making high resolution charge transfer images with gray scale fidelity and high transfer efficiency.

One aspect of the invention is to provide an efficient charge donating photoconductive-insulative surface.

Another aspect of the invention is to efficiently transfer a high resolution latent electrostatic charge image from the charge donating photoconductive-insulative surface to the charge receptor medium while these surfaces are in virtual contact.

U.S. Pat. No. 2,825,814 teaches a method for maintaining spacing by placing between the surfaces of the photoconductive and receiving layers a small quantity of powdered resin or plastic which is obtained by grinding the material to a relatively uniform particle size. However, the dusted particles tend to adhere to both surfaces, the final image areas often contain blotches caused by the presence of the particles used to maintain the spacing, and the resin particles and thus the spacing are not uniform. These disadvantages result in poor transferred images upon toning.

U.S. Pat. No. 3,519,819 discloses maintaining a spacing by coating a thin layer of electrically insulating film forming polymeric binder containing particulate spacer particles. These particles are embedded in the polymer binder layer in such a manner that the amount by which these spacer particles protrude determines the air gap thickness. However, because the particle size distribution of the spacer particles is random and each particle is not deposited in the same orientation within the binder, the amount by which each particle protrudes about the substrate is not uniform. Thus a uniform air gap cannot be achieved readily.

U.S. Pat. No. 3,240,596 teaches the use of direct contact between the photoconductive layer and the dielectric receiving layer in an imaging process. The charge transfer is slow and inefficient with a large amount of bias or background charge being transferred. This causes mottling in the background and a generally poor image.

U.S. Pat. No. 4,263,359 teaches the use of microdots of a photopolymerized composition on the receptor layer to provide uniform spacing in the air gap between the dielectric receiving layer and the photoconductor layer. This technique improves the consistency of the spacing between the layers, but charge transfer must still be effected by breakdown in the air gap and with an attendant bias voltage applied. Charge transfer is also quite slow and inefficient.

DISCLOSURE OF THE INVENTION

The present invention is a process in which an imagewise distributed electrostatic charge is transferred in an imaging process by contact between a photoconductive layer and a dielectric receiving layer wherein at least one of said layers has adhered to its surface conductivity sites comprising an inorganic material having an average size (measured along the plane of the surface) in the range of between about 2.5 and 9.0 nanometers.

The distribution can be quite large, however. For example, when the average size is about 7.0 nm, the range in particle sizes can be from 5 to 12.0 nm, or even have a greater size distribution. The average particle size does appear to be critical to the practice of the invention even though the distribution may be broad. The distribution tends to be a result of the various processes of manufacture, however, and a broad distribution range is neither essential nor necessarily desirable. The broad average size range appears to be from 1.0 to 20 nm. The preferred range is between 2.5 and 9.0 nm. The more preferred range is from 3.0 to 8.0 nm, and the most preferred average sizes are between 3.5 and 7.5 nm.

In addition to the criticality of the average particle size of the conductivity sites, the spacing of the sites should be within reasonable limits. The sites should cover between 0.1 to 40% of the surface area, preferably 0.15 to 30% and more preferably 0.20 to 20% of the surface area. If more area is covered, the surface essentially becomes a conductor. If less area is covered, the effects of the sites tend to not be noticeable.

Essentially any solid, environmentally stable inorganic material may be used as the composition of the conductivity sites. By environmentally stable it is meant that the material, in particulate form of from 2.5 to 9.0 nm, in air at room temperature and 30% relative humidity will not evaporate or react with the ambient environment to form a non-environmentally stable material within one minute. Metal particles can be deposited and, if these react to form environmentally stable metal oxide particles, are acceptable. Copper and nickel perform this way, for example. Metals which react to form unstable products within that time period, e.g., metal oxides which sublime or are liquid, would not be suitable. Surprisingly it has been found that the beneficial effect of the sites appears to be solely a function of conductivity site density and is independent of the bulk resistivity properties of the composition although it is desirable for the material to have a bulk resistivity of less than or equal to $1\times10^{18}$ and more preferably $1\times10^{12}$ ohm-centimeters. For example, silica ($SiO_2$), alumina and chromia have been found to be quite effective in increasing the charge acceptance characteristics of the surface even though it is an insulator. Essentially all environmentally stable material having the described average particle size and distribution work in the present invention. Specific materials used include nickel, zinc, copper, silver, cobalt, indium, chromium/nickel alloy, stainless steel, aluminum, tin, chromium, manganese, quartz, window glass, and silica. Oxides of these materials and mixtures of metals and metal oxides of these materials also work quite well. It is apparent that sulfides, carbonates, halides and other molecules of metals and the like should also work in the present invention.

The conductivity sites may be deposited on the surface by a number of different processes, including but not limited to radio frequency (R.F.) sputtering, vapor deposition, chemical vapor deposition, thermal evaporation, A.C. sputtering, D.C. sputtering, electroless deposition, drying of sols, and drying in dilute solutions of the metal or compounds. The objective of all these processes is the distribution of controlled size particles. This is achievable in these processes by control of the speed, concentration of ingredients, and energy levels used. In almost all cases atomic or molecular size material is contacted with the surface and these materials tend to collect at nucleation sites or minute flaws in the surface. As the particles grow by attraction and accumulation of additional material, the process is carefully controlled to insure that the proper size and distribution of particles is effected. These procedures would be readily understood by one of ordinary skill in the art.

The process used for manufacturing the layers of the present invention comprises the process of forming an atomic or molecular atmosphere of the material to be deposited and allowing the elements and/or molecules to deposit on the surface which is to be coated at a rate and for a time sufficient to form the desired distribution of sites. This process can be done on existing thermal evaporation (also known as vapor coating) apparatus and sputtering apparatus. No modification of existing apparatus is essential in practicing this process, but care must of course be exercised that the appropriate concentration and distribution of sites be obtained. For example, if the surface to be coated is exposed to an atmosphere with a high concentration of metal or metal oxide for too great a time, a film would be deposited rather than a distribution of sites.

The process, using R.F., A.C. or D.C. sputtering and thermal evaporation has to date been the best process for providing consistent results and for ready control of properties.

The effectiveness of the process for making charge receptive surfaces can be determined in a simple test. A control electrophotographic sheet comprising the sheet used in Example 1 is charged to 450 volts. The charge surface of this sheet is contacted by the treated surface of the present invention. If at least 25% of the charge on the sheet is transferred within five seconds of contact, the material selected is clearly satisfactory.

A preferred utility of the present invention to provide a primed surface exhibiting enhanced adhesion is accomplished when a metal or metal oxide is selected as the material for producing the conductivity sites, a polymer such as polyester is selected as dielectric substrate and R.F. sputter deposition is carried out in a reactive oxygen atmosphere. The polymer surface is considered primed if it passes the adhesive tape peel test. This test consists of ANSI/ASTM D 903-49 (Reapproved 1978) and is performed by placing a piece of Scotch Brand Magic Mending Tape onto the treated surface and pressing it down to obtain firm adherence. Subsequently, the tape is peeled at moderate speeds (approximately 50 cm/min). A surface that is primed shows a uniform splitting of the adhesive from the tape backing.

The use of these conductivity sites on at least one surface dramatically improves the speed and efficiency of charge transfer during imaging processes. Charge transfer in excess of 30% is readily obtained and in some cases transfer in excess of 40% is obtained in a few seconds. Resolution of the toned images is also quite outstanding.

In addition to using the conductivity sites on only the photoconductive layer or the dielectric receiving layer, the sites may be used on both layers to further improve the charge transfer efficiency and speed of charge transfer.

Another significant benefit of using contact charge transfer according to the present invention is that biasing voltage is not required. Although bias voltage is preferably not used to reduce the energy requirements of the imaging process, it can be used and may be desirable under certain processing conditions.

Objects and advantages of this invention are further illustrated by the following examples, but the particular materials and amounts thereof recited in these examples, as well as the conditions and details, should not be construed to unduly limit this invention.

EXAMPLE 1

A charge receptor was fabricated by selecting as a substrate a 15 cm long×10 cm wide piece of 75μ thick polyester. Upon the substrate was vacuum vapor deposited (i.e., thermally evaporated) an aluminum metal layer which had a white light transparency of about 60 percent and a resistance of about 90 ohms/square. Subsequently, a dielectric layer was hand coated from a 15 wt. % Vitel® PE 200 (polyester from Goodyear Tire and Rubber Co.)/85 wt. % dichloroethane solution using a #20 Meyer bar which resulted in dried thickness of about 5μ. Further processing was done in a Veeco® Model 776 radio frequency diode sputtering apparatus operating at a frequency of 13.56 MHz, modified to include a variable impedence matching network. The apparatus included two substantially parallel shielded circular aluminum electrodes, one of which (cathode) was 40 cm in diameter and the other (anode) was 20 cm in diameter with a 6.25 cm gap between them. The electrodes were housed in a glass jar provided with R.F. shielding. The bell jar was evacuatable and the cathode (driven electrode) and anode (floating electrode) were cooled by circulating water.

The foregoing composite was centrally placed on the aluminum anode with the dielectric layer facing the cathode. The source of the material to be sputter deposited was a copper plate, which plate was attached to the cathode thus facing the composite structure on the anode.

The system was then evacuated to about $1\times10^{-5}$ torr, and oxygen gas introduced through a needle valve. An equilibrium pressure in the range of $5\times10^{-4}$ torr to $8\times10^{-4}$ torr was maintained as oxygen was continuously introduced and pumped through the system.

With a shutter shielding the anode and composite structure thereon, R.F. energy was capacitively coupled to the cathode, initiating a plasma. The energy input was increased until a cathode power density of 0.38 watts/cm$^2$ was reached, thus causing copper to be sputtered from the cathode and deposited on the shutter. This cathode cleaning operation was carried on for about ten minutes to assure a consistent sputtering surface. The cathode power was then reduced to 0.15 watts/cm$^2$ and the sputtering rate was allowed to become constant as determined by a quartz crystal monitor. A typical sputtering rate was nominally 0.1 nm/60 seconds. The shutter was then opened and the reactive sputter deposition of copper metal onto the dielectric layer was continued for about 60 seconds. Reflected power was less than 2 percent. The coupling capacitance maintained the above stated power density. In 60 seconds, the average film thickness was, therefore, approximately 0.1 nm. A charge receptor surface consisting of copper or copper oxide conductivity sites having a median size of about 7.0 nm and an average spacing of about 20 nm was thus formed.

A charge donor material was treated in a similar manner. However, the composite structure consisted of a 75μ thick polyester layer covered by a conductive indium iodide layer, which in turn was covered by an 8.5μ thick organic photoconductive-insulative layer commercially available from Eastman Kodak Company as EK SO-102, in the R.F. sputtering apparatus discussed above with the exception that the material deposited was 304 stainless steel. The average thickness of the stainless steel deposited was nominally 0.05 nm and formed a distribution of conductivity sites on the surface of the photoconductive-insulative layer.

The photoconductive-insulator layer used above (EK SO-102) comprises a mixture of (1) a polyester binder derived from terephthalic acid, ethylene glycol and 2,2-bis(4-hydroxyethoxyphenyl)propane, (2) a charge transport material comprising bis(4-diethylamino-2-methylphenyl)phenylmethane, and (3) a spectral sensitizing dye absorbing at green and red wavelengths in combination with a photographic supersensitizer.

The charge donor was then charged to +900 volts using a corona source and image-wise exposed to generate a high resolution electrostatic charge pattern. With the electrostatic charge pattern on its surface, the charge donor was then brought into intimate contact with a charge receptor using a grounded electrically conductive rubber roller. The roller provides electrical contact to the back electrode for the charge receptor as well as providing the moderate pressure needed for good contact. Measurement of the surface potential on the charge receptor after separation from charge donor indicated that about 50% of the electrostatic charge transferred. The transferred electrostatic charge pattern was then stored as long as several days and subsequently developed, or developed immediately with toner to reveal a visible image of the charge pattern.

A suitable toner for development of the transferred electrostatic charge was composed as shown in Table I.

TABLE I

| Raw Material | Proportions by weight | % Composition by weight |
|---|---|---|
| Tintacarb 300[a] | 2 | 10.5 |
| Polyethylene AC-6[b] | 1 | 5.3 |
| OLOA 1200[c] | 4 | 21.0 |
| Isopar M[d] | 12 | 63.2 |
| | | 100.0 |

[a]Tintacarb 300 Carbon Black manufactured by Australian Carbon Black, Altona, Victoria, Australia
[b]Polyethylene AC-6, low molecular weight polyethylene manufactured by Allied Chemicals, New York
[c]OLOA 1200, an oil soluble succinimide manufactured by the Chevron Chemical Company, San Francisco, California
[d]Isopar M, Isoparaffinic hydrocarbon, high boiling point, manufactured by Exxon Corp.

The toner components were mixed according to the following sequence:

1. The carbon black was weighed and added to a ball jar.
2. The Polyethylene AC-6, OLOA 1200 and Isopar M were weighed into a common container, preferably a glass beaker, and the mixture heated on a hotplate with stirring until solution occurred. A temperature of 110° C.±10° C. was sufficient to melt the polyethylene and a clear brown solution was obtained.
3. The solution from (2) was allowed to cool slowly to ambient temperature, preferably around 20° C., in an undisturbed area. The wax precipitated upon cooling, and the cool opaque brown slurry so formed was added to the ball jar.
4. The ball jar was sealed, and rotated at 70–75 rpm for 120 hours. This milling time was for a jar of 2600 mL nominal capacity, with an internal diameter of 18 cm. A jar of these dimensions would take a total charge of 475 g of raw materials, in the proportions stated in Table I.
5. Upon completion of the milling time, the jar was emptied and the contents placed in a suitable capacity container to form the final toner concentrate designated MNB-2.

The resultant image was of excellent quality wherein the optical density was about 1.4, the resolution was about 216 lp/mm and the slope ($\gamma$) in the linear portion of optical density as a function of log exposure was about 1.1.

COMPARATIVE EXAMPLE 1

A charge receptor and a charge donor were prepared as in Example 1, however, no conductivity sites were deposited on either of the articles. When the image-wise exposure, electrostatic charge image transfer and transferred charge development were carried out as in Example 1, only about 9% of the electrostatic charge transferred and the resolution of the developed image was only about 100 lp/mm.

COMPARATIVE EXAMPLE 2

A charge receptor and a charge donor were prepared as in Example 1, however, no conductivity sites were deposited on the charge receptor. When the image-wise exposure, electrostatic charge image transfer and transferred charge development were carried out as in Example 1, only about 28% of the electrostatic charge transferred and the resolution of the developed image was only about 150 lp/mm.

COMPARATIVE EXAMPLE 3

A charge receptor and a charge donor were prepared as in Example 1, however, no conductivity sites were deposited on the charge donor. When the image-wise exposure, electrostatic charge image transfer and transferred charge development were carried out as in Example 1, only about 39% of the electrostatic charge transferred and the resolution of the developed image was only about 170 lp/mm.

EXAMPLES 2–14

Electrostatic charge image patterns were generated, transferred and developed as in Example 1 with the exception that chromium (Cr), silver (Ag), tin (Sn), cobalt (Co), manganese (Mn), nickel (Ni), iron (Fe), molybdenum (Mo), stainless steel, zinc (Zn), aluminum (Al), window glass and quartz were used respectively to generate the conductivity sites on the charge receptor. Results obtained thus far indicate charge transfer efficiencies in excess of 30% and developed resolutions greater than 170 lp/mm for all these examples.

The utility of the present invention in providing sites with various other materials and surfaces is demonstrated in the following additional examples.

EXAMPLE 15

A 12.5 cm×25.0 cm piece of 75μ thick polyester was selected as the substrate. The R.F. sputtering apparatus of Example 1 was utilized with the exception that the anode was 40 cm in diameter. The substrate was placed on the anode, the chamber evacuated and an equilibrium pressure in the range of $5\times10^{-4}$ torr to $10\times10^{-4}$ torr of oxygen was maintained. Copper was sputtered at a cathode power in the range of 0.38 watts/cm$^2$ to 0.46 watts/cm$^2$. The deposition was stopped when about 0.5 nm of copper had been deposited.

EXAMPLE 16

A 12.5 cm×25.0 cm piece of 75μ Tedlar® (polyvinylfluoride) was selected as the substrate and treated as in Example 15.

EXAMPLE 17

A 12.5 cm×25.0 cm piece of 75μ polyethylene was selected as the substrate and treated as in Example 15.

EXAMPLE 18

Continuous R.F. reactive sputter treatment was also utilized to form sites on polymer surfaces. A 15 cm wide roll of polybutyleneterephthalate (PBT) was loaded on a web handling apparatus and inserted into the vacuum chamber of a planar magnetron sputtering system. The vacuum chamber was evacuated to approximately $5\times10^{-6}$ torr and oxygen admitted to obtain a flow rate of 54 standard cc/min with a chamber pressure in the range of $10\times10^{-3}$ torr to $25\times10^{-3}$ torr. The web was passed by a copper planar magnetron sputter deposition cathode at a rate of 0.1 to 2 cm/sec. The cathode to web spacing was 6 cm. The gas plasma was formed by driving the cathode by a radio frequency (13.56 MHz) generator at a power in the range of 1.1 watts/cm$^2$ to 3.4 watts/cm$^2$. Excellent results were obtained with this product.

EXAMPLE 19

A 15 cm wide roll of single layer 60/40 copolymer of polyethyleneterephthalate and polyethyleneisophthalate was treated as in Example 18.

EXAMPLES 20–21

The materials of Examples 18 and 19 were primed as in Example 18 with the exception that the planar magnetron sputter deposition cathode was chromium. These surfaces were particularly stable in humid environments.

EXAMPLES 22–23

The materials of Examples 18 and 19 were primed as in Example 18 with the exception that the planar magnetron sputter deposition cathode was aluminum and the gas plasma was formed by driving the cathode by a direct current (D.C.) generator at a power in the range of 1.1 watts/cm$^2$ to 1.3 watts/cm$^2$.

An ESCA (electron spectroscopy for chemical analysis) study of surfaces of polymers that were treated under plasma conditions, as disclosed in the examples, was conducted. A determination of properties and conditions that resulted in priming versus conditions and properties which did not result in priming was sought. In the case of forming sites with chromium, which is preferred in this disclosure, the Cr $2p^{3/2}$ binding energy for the coated surfaces was 576.6 ev, whereas the Cr $2p^{3/2}$ binding energy for uncoated surfaces was 577.1 ev. In the case of forming sites with aluminum, the Al 2s binding energy for the coated surfaces was 119.0 ev, whereas the Al 2s binding energy for uncoated surfaces was 119.3 ev. All binding energies are referenced to C 1s which is at 284.6 ev. The determined bonding energies have been found to be a function of the preparation conditions and not of the average deposited metal thickness as reported by J. M. Burkstrand (J. Appl. Phys., 52 (7), 4795 July, 1981).

EXAMPLE 24

A 4 inch×6 inch (approximately 10 cm×15 cm) sample of polyester with vapor deposited film of aluminum (60% transmissive) as a conductive layer thereon was coated with 5 micrometers of polyester (Vitel® PE 200). This film composite was placed in a vacuum chamber equipped with a thermal evaporation assembly and a shutter. The composite was place approximately 20 cm above the source of material to be deposited. The system was evaporated to $1-2\times10^{-5}$ torr, and, with the shutter closed, power was applied to the copper filled tungsten support boat. When the deposition rate was constant, as evidenced by readings from a thickness monitor, the shutter was opened and 0.1 nanometers of copper was deposited. The 0.1 nanometer coated sample was tested according to the same procedures used in Example 1 and was found to provide transferred resolution after development of greater than 100 lp/mm.

EXAMPLE 25

A charge receptor was prepared as in Example 1 with the exception that gold (Au) was used as the metal in forming the conductive sites. The charge donor was a plain cadmium sulfide crystalline photoreceptor commercially available from Coulter Systems Company as KC101. After image-wise exposure, electrostatic charge transfer and transferred charge development were carried out according to the method of Example 1, the developed image had a resolution of 130 lp/mm. About 4.0% of the charge had been transferred.

The imaging and developing process was repeated on an identical receptor without conductivity sites and no image could be produced, and no charge transfer could be detected.

EXAMPLE 26

The previous example was repeated except that the photoreceptor comprised a 1.59 mm thick aluminum blanket covered by a 40 micrometer amorphous composition comprising 94% by weight selenium and 6% by weight tellurium. Resolution of the developed image was 120 lp/mm. About 40% of the charge had been transferred during the process.

Metalloids are equally useful in the practice of the present invention in place of or in combination with the metals and metal compounds described above. Metal alloys, metal-metalloid alloys, and metalloid alloys are also useful and can be applied as discrete sites according to the procedures described above. Metalloids are elements well understood in the art and include, for example, silicon, boron, arsenic, germanium, gallium, tellurium, selenium and the like. The metalloids, in the same fashion as the metals, may be present in the form of metalloid compounds. The terms "metal compounds" and "metalloid compounds" are defined according to the present invention to mean oxides, chalconides (e.g., sulfides), halides, borides, arsenides, antimonides, carbides, nitrides, silicides, carbonates, sulfates, phosphates, cluster compounds of metals and metalloids, and combinations thereof.

Terms such as 'oxide' do not require the presence of a stoichiometric equivalence. For example, compounds having an excess or deficiency of stoichiometric oxygen are useful and can be produced according to the above techniques. The sputter deposition of silica in an inert environment tends to produce a sub-oxide, for example.

We claim:

1. A process for providing an image by transferring an imagewise distributed charge from one surface to another and subsequently forming a visible image on the another surface to which said charge is transferred characterized by the fact that said transferring is effected by close proximity between two surfaces at least one of which surfaces has conductivity sites comprising discrete sites of an inorganic material, said discrete sites having an average length of between 1.0 and 20.0 nm and covering between 0.1 and 40% of said surface.

2. The process of claim 1 wherein said inorganic material comprises an environmentally stable material selected from the group consisting of metals, metalloids, metal compounds, metalloid compounds, and combinations thereof.

3. The process of claim 2 wherein the sites have an average length of between 2.5 and 9.0 nm and covering between 0.15 and 30% of said surface.

4. The process of claim 2 wherein said transferring is effected by contact between said two surfaces.

5. The process of claim 2 wherein said two surfaces comprise a photoconductive layer and a dielectric receiving layer, both layers having conductive layers on the surfaces which are not in contact.

6. The process of claim 3 wherein said two surfaces comprise a photoconductive layer and a dielectric receiving layer, both layers having conductive layers on the surfaces which are not in contact.

7. The process of claim 4 wherein said two surfaces comprise a photoconductive layer and a dielectric receiving layer, both layers having conductive layers on the surfaces which are not in contact.

8. The process of claim 2, 3, 4, 5, 6, or 7 wherein said discrete sites are on said photoconductive layer.

9. The process of claim 2, 4, 5, 6, or 7 wherein said discrete sites are on said dielectric receiving layer.

10. The process of claim 1, 2, 3, 4, or 5 wherein said discrete sites comprise metal, metal oxide, metal sulfide, metal carbonate, metal halides, or mixtures thereof.

11. The process of claim 1, 2, 3, 4, or 5 wherein the visible image is formed by toning the said another surface.

* * * * *